United States Patent [19]

Greune et al.

[11] Patent Number: 4,810,165

[45] Date of Patent: Mar. 7, 1989

[54] ADJUSTING MECHANISM FOR GUIDE BLADES OF TURBO-PROPULSION UNITS

[75] Inventors: Christian Greune, Fuerstenfeldbruck; Hilbert Holzhauer, Stetten, both of Fed. Rep. of Germany

[73] Assignee: MTU Motoren- und Turbinen-Union Munchen GmbH, Fed. Rep. of Germany

[21] Appl. No.: 71,071

[22] Filed: Jul. 8, 1987

[30] Foreign Application Priority Data

Jul. 9, 1986 [DE] Fed. Rep. of Germany ..... 3623001

[51] Int. Cl.[4] ..... F04D 29/36

[52] U.S. Cl. ..... 415/156; 415/134

[58] Field of Search ..... 415/149 R, 156, 160, 415/162, 134, 136, 138, 139, 150, 151, 155

[56] References Cited

U.S. PATENT DOCUMENTS

| | | | |
|---|---|---|---|
| 2,651,496 | 9/1953 | Buckland et al. | 415/135 |
| 2,932,440 | 4/1960 | Hemsworth | 415/156 |
| 2,933,234 | 4/1960 | Neumann | 415/160 |
| 2,936,108 | 5/1960 | Balcom et al. | 415/137 |
| 3,303,992 | 2/1967 | Johnson | 415/160 |
| 3,652,177 | 3/1972 | Loebel | 415/156 |
| 3,841,788 | 10/1974 | Sljusarev et al. | 415/160 |
| 3,990,809 | 11/1976 | Young et al. | 415/160 |
| 4,035,101 | 7/1977 | Glenn | 415/160 |
| 4,150,915 | 4/1979 | Karstensen | 415/139 |
| 4,330,234 | 5/1982 | Colley | 415/138 |
| 4,363,600 | 12/1982 | Thebert | 415/156 |
| 4,400,135 | 8/1983 | Thebert | 415/149 R |
| 4,709,546 | 12/1987 | Weiler | 415/116 |

FOREIGN PATENT DOCUMENTS

| | | | |
|---|---|---|---|
| 1108988 | 6/1961 | Fed. Rep. of Germany . | |
| 755527 | 8/1956 | United Kingdom | 415/156 |

*Primary Examiner*—Robert E. Garrett
*Assistant Examiner*—John T. Kwon
*Attorney, Agent, or Firm*—Barnes & Thornburg

[57] ABSTRACT

An adjusting mechanism for pivotal guide blades of turbo-propulsion units in which a rotatable adjusting ring is supported in a concentric support ring. The support ring is heat-insulatingly connected with the turbine housing by way of several connecting lugs or slide block guidances distributed over the circumference and the adjusting ring is connected with the guide blades by way of bendable pivot levers. It is achieved thereby that the heat flow from the hot turbine housing to the adjusting mechanism remains small and an exact adjustment of the guide blades can be achieved in this manner.

11 Claims, 3 Drawing Sheets

ADJUSTING MECHANISM FOR GUIDE BLADES OF TURBO-PROPULSION UNITS

BACKGROUND AND SUMMARY OF THE INVENTION

The present invention relates to an adjusting mechanism for pivotal guide blades of turbo-propulsion units with an adjusting ring disposed outside of the turbine housing which is rotatably supported by way of bearings at a coaxial support ring and on which pivot levers of the guide blades bendable perpendicularly to the pivot plane on the blade side are movably arranged in four degrees of freedom.

Such an adjusting mechanism is disclosed in the U.S. Pat. No. 2,933,234. The adjusting ring is thereby supported by way of slide members at concentrically inwardly disposed support ring segments which, in turn, are secured at the housing of the turbo-propulsion unit. The bendable pivot levers of the guide blades are supported in the adjusting ring by way of ball joints. This arrangement has as a consequence that the propulsion unit heat is transmitted unobstructedly onto the adjusting mechanism whereby large temperature differences result between the start and operating phase of the propulsion unit with correspondingly high thermal expansions of the adjusting mechanism. In order to be able to absorb the same, sufficient elasticities or clearances must be provided in the adjusting mechanism. This, in turn, leads to inaccuracies of the guide blade adjustments by reason of the large actuating forces to be transmitted which are then connected with efficiency losses. It may even lead to mechanical damages, for example, as a result of vibrations.

It is the object of the present invention to avoid these disadvantages and to assure an exact adjustment of the guide blades independently of the temperature fluctuations caused by the differing operating conditions.

The underlying problems are solved according to the present invention, in that the support ring is connected heat-insulatingly with the turbine housing by way of several connecting lugs distributed over the circumference.

It is achieved by this arrangement that the heat flow from the turbine housing to the support- and adjusting-ring remains relatively small independently of the operating condition of the propulsion unit and the same retains an approximately constant temperature. As the turbine housing is generally surrounded by a cooling air stream, the heat conduction by way of the connecting lugs is further restricted.

Small thermal expansions in the axial direction of the propulsion unit can be absorbed by the lugs without errors for the blade adjustment whereas the coaxiality of the support ring and propulsion unit remains assured.

Preferably, the connecting lugs are flat sections of an annular band. A surface-/cross-section ratio can be achieved thereby favorable for reduced heat conduction. Additionally, the connecting lugs have a certain elasticity in the radial direction, as a result of which the differing thermal expansions of the turbine housing which becomes hot during operation and of the adjusting- and support-ring which remain cool can be compensated for.

In a particular embodiment of this invention, the connecting lugs are connected with a fastening ring secured at the turbine housing. As a result thereof, a simple and accurate assembly of the adjusting mechanism can be achieved.

In a further embodiment of this invention, the support ring, the fastening ring and the connecting lugs are combined into a bearing ring which is constructed as an integral component which leads to a simplification of the manufacture.

The bearing ring, according to another embodiment of the present invention, may consist of two or several ring segments connected with each other whereby the fastening of the adjusting mechanism is facilitated.

In an alternative embodiment of the invention, the support ring is connected with the turbine housing by way of several slide block guidances distributed over the circumference. As a result thereof, the support ring is movable in the axial direction of the propulsion unit and can thus absorb advantageously differing thermal expansions of the support ring and of the housing. Additionally, the heat flow from the housing into the ring is reduced.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figure 1:
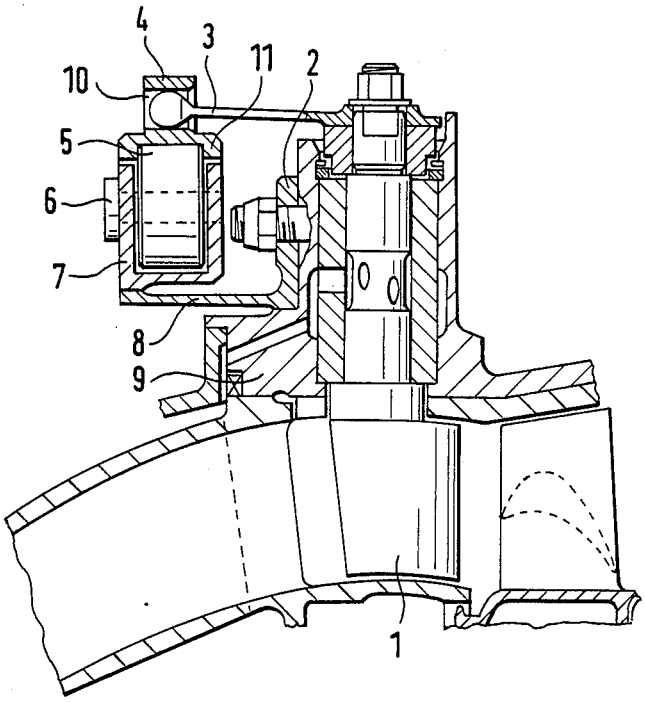
FIG. 1 is a longitudinal cross-sectional view through a guide blade rim in accordance with the present invention.
Figure 2:
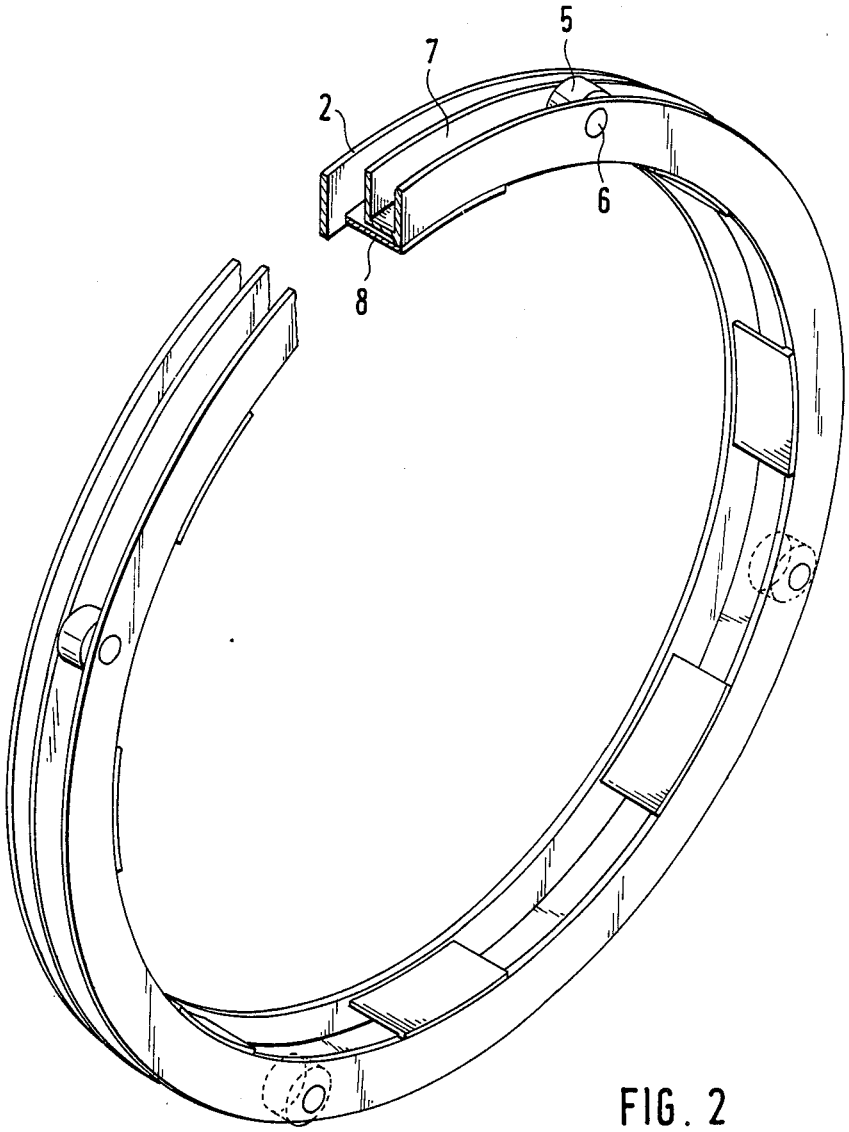
FIG. 2 is a partial perspective view of the support- and fastening-ring of FIG. 1.

Referring now to the drawing wherein like reference numerals are used throughout the various views to designate like parts, and more particularly to FIG. 1, according to this figure, a fastening ring 2 is threadably secured at the turbine housing 9. The fastening ring 2 is connected with the U-shaped support ring 7 (FIG. 2) by way of flat connecting lugs 8. The adjusting ring 4 is rotatably supported in the circumferential direction by way of guide rollers 5 uniformly distributed over the circumference which are mounted in the support ring 7 by bolts 6, whereby the accurate guidance of the adjusting ring 4 is assured by the shoulders 11 of the adjusting ring 4.

The adjusting ring 4 is provided with axial bores 10 in which are guided the ball-shaped ends of the pivot levers 3. On the side of the blades, the pivot levers 3 are securely connected with the pivotal guide blades 1. For purposes of adjusting the guide blades 1, the adjusting ring 4 is rotated in the circumferential direction by a mechanism of any known construction (not shown) whereby the ball-shaped ends of the pivot lever 3 which are located in the bores 10 are moved along and in this manner pivot the guide blades 1. The pivot levers 3 are thereby elastically bent.

The connecting lugs 8 and the pivot levers 3 are constructed as flat tongues, as a result of which the heat flow from the hot turbine housing 9 onto the adjusting mechanism remains small.

Figure 3:
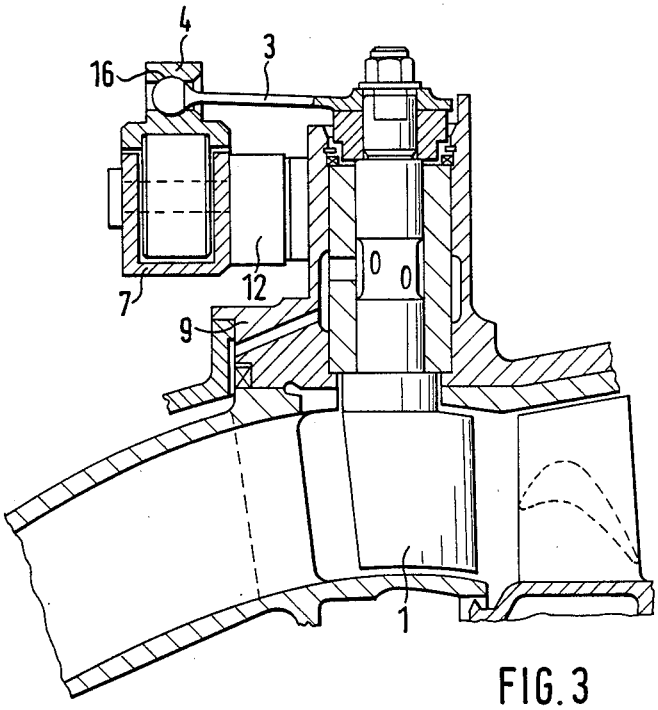
FIG. 3 is a longitudinal cross-sectional view through a modified embodiment of a guide blade rim in accordance with the present invention.

In the embodiment illustrated in FIG. 3, the support ring 7 is connected with the turbine housing 9 by way of slide block guidances generally designated by reference numeral 12.

Figure 4:
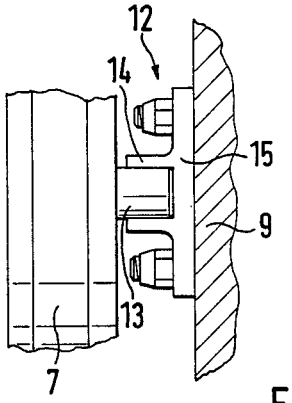
FIG. 4 is a plan view on the slide block guidances in accordance with the present invention.

The slide block guidances 12 distributed over the circumference consist—as can be seen in FIG. 4—of a pin 13 attached on the side of the support ring which is movably arranged between guide shoulders 14 of a fastening profile 15 threadably secured at the turbine housing 9. The pivot lever 3 is supported in the illustrated embodiment in a ball socket 16 of the support ring 4 as a result of which a surface contact between pivot lever 3 and support ring 4 is achieved in an advantageous manner.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An adjusting mechanism for pivotal guide blades of turbo-propulsion units, comprising a turbine housing means, an adjusting ring means located outside of the turbine housing means, a coaxial support ring means, the adjusting ring means being rotatably supported on said support ring means by way of bearing means, bendable pivot levers bendable substantially perpendicularly to the pivot plane and operatively connected with the guide blades, said pivot levers being movably arranged at the adjusting ring means on the blade side thereof, and connecting means connecting the support ring means with the turbine housing means in a heat-insulating manner by way of a plurality of separate connecting elements distributed over the circumference of the turbine housing means, thereby minimizing heat transfer from the turbine housing means to the supporting ring means and adjusting ring means, wherein the connecting elements are connecting lugs formed as separate spaced flat sections of an annular band.

2. An adjusting mechanism according to claim 1, wherein the connecting lugs are connected with a fastening ring secured at the turbine housing means.

3. An adjusting mechanism according to claim 2, wherein the support ring means, the fastening ring and the connecting lugs are constructed as an integral structural part.

4. An adjusting mechanism according to claim 3, wherein the structural part consists of at least two ring segments connected with each other.

5. An adjusting mechanism according to claim 3, wherein the structural part consists of several ring segments connected with each other.

6. An adjusting mechanism according to claim 2, wherein said fastening ring is a substantially flat annular ring and the connecting lugs protrude axially from an edge of a flat annular face of the fastening ring and serve to hold the support ring means at an axial spacing from the fastening ring.

7. An adjusting mechanism according to claim 6, wherein the support ring means, the fastening ring and the connecting lugs are constructed as an integral structural part.

8. An adjusting mechanism according to claim 11, wherein the structural part consists of at least two ring segments connected with each other.

9. An adjusting mechanism, for pivotal guide blades of turbo-propulsion units, comprising a turbine housing means, an adjusting ring means located outside of the turbine housing means, a coaxial support ring means, the adjusting ring means being rotatably supported on said support ring means by way of bearing means, bendable pivot levers bendable substantially perpendicularly to the pivot plane and operatively connected with the guide blades, said pivot levers being movably arranged at the adjusting ring means on the blade side thereof, and connecting means connecting the support ring means with the turbine housing means in a heat-insulating manner by way of a plurality of separate connecting elements distributed over the circumference of the turbine housing means, thereby minimizing heat transfer from the turbine housing means to the supporting ring means and adjusting ring means, wherein the connecting means includes several slide block guide means distributed over the circumference for connecting the support ring means with the turbine housing means.

10. An adjusting mechanism according to claim 9, wherein the slide block guide means are each substantially radially directed.

11. An adjusting mechanism according to claim 9, wherein pin means are attached to an axial side of the support ring which faces the slide block guide means, said slide block guide means including guide surfaces engageable with the pin means to support the support ring while permitting movement of the support ring in the axial direction of the propulsion unit.

* * * * *